US009272818B2

(12) United States Patent
Turvey et al.

(10) Patent No.: US 9,272,818 B2
(45) **Date of Patent: *Mar. 1, 2016**

(54) FLEXIBLE CONTAINER

(71) Applicant: S.C. Johnson & Son, Inc., Racine, WI (US)

(72) Inventors: Robert R. Turvey, Sanford, MI (US); William E. LeBoeuf, Midland, MI (US); Hannah E. Wilson, Mystic, CT (US)

(73) Assignee: S.C. Johnson & Son, Inc., Racine, WI (US)

( * ) Notice: Subject to any disclaimer, the term of this patent is extended or adjusted under 35 U.S.C. 154(b) by 34 days.

This patent is subject to a terminal disclaimer.

(21) Appl. No.: 14/260,411

(22) Filed: Apr. 24, 2014

(65) Prior Publication Data

US 2014/0307984 A1 Oct. 16, 2014

Related U.S. Application Data

(63) Continuation of application No. 12/315,203, filed on Dec. 1, 2008, now Pat. No. 8,746,495.

(51) Int. Cl.
*B65D 33/06* (2006.01)
*A45C 7/00* (2006.01)

(52) U.S. Cl.
CPC ..... *B65D 33/06* (2013.01); *A45C 7/0077* (2013.01)

(58) Field of Classification Search
CPC ..... B65D 33/01; B65D 33/10; B65D 33/16; B65D 37/00
USPC ..... 220/62.22, 677, 753, 754, 666, 769, 220/767, 348; 215/201, 209, 221, 322, 301, 215/216, 280, 287; 206/528, 540
See application file for complete search history.

(56) References Cited

U.S. PATENT DOCUMENTS

| | | | |
|---|---|---|---|
| 1,305,199 | A | 5/1919 | Deubener |
| 1,379,829 | A | 5/1921 | Lawrence |
| 1,898,838 | A | 2/1933 | Katz |
| 2,040,337 | A | 5/1936 | Rosmait |
| 2,050,967 | A | 8/1936 | Farmer |
| 2,192,131 | A | 2/1940 | Fishwick |
| 2,237,324 | A | 4/1941 | Wolf |
| 2,319,127 | A | 5/1943 | Guenther et al. |
| 2,513,040 | A | 6/1950 | Miller |
| 2,722,368 | A | 11/1955 | Gottsegen |
| 3,126,146 | A | 3/1964 | Bonsor |
| 3,197,062 | A | 7/1965 | Day et al. |
| 3,229,741 | A | 1/1966 | Ambrose |
| 3,462,069 | A | 8/1969 | Suominen |
| 3,568,918 | A | 3/1971 | Blomqvist |
| 3,672,562 | A | 6/1972 | Bosse |
| 3,797,733 | A | 3/1974 | Ibing |
| 4,127,155 | A | 11/1978 | Hydorn |

(Continued)

*Primary Examiner* — Jeffrey Allen

(57) ABSTRACT

A flexible container includes a bottom wall, a plurality of side walls, each extending upwardly from the bottom wall and each having a top end defining an opening into an interior of the container, and a top wall connected to the top end of at least one of the side walls. The top wall covers the opening. A continuous mesh layer is connected to the top end of at least one of the side walls and provides ventilation to the interior of the container. A flexible handle is attached to an exterior surface of at least one of the side walls. The handle includes multiple layers of flexible thermoplastic material connected together, with a first end of the handle being attached to (i) the at least one side wall near the top end thereof, and (ii) the continuous mesh layer.

38 Claims, 9 Drawing Sheets

(56) References Cited

U.S. PATENT DOCUMENTS

| | | | |
|---|---|---|---|
| 4,539,705 | A | 9/1985 | Baines |
| 4,691,369 | A | 9/1987 | Costa |
| 4,822,179 | A | 4/1989 | Nattrass |
| 4,846,587 | A | 7/1989 | Hull |
| 4,848,930 | A | 7/1989 | Williams et al. |
| 4,877,335 | A | 10/1989 | Barnard |
| 4,895,456 | A | 1/1990 | Morita |
| 4,971,453 | A | 11/1990 | Rantanen |
| 4,989,993 | A | 2/1991 | Barnard |
| 5,033,868 | A | 7/1991 | Peppiatt |
| 5,046,860 | A | 9/1991 | Brennan |
| 5,062,717 | A | 11/1991 | Shockley |
| 5,108,196 | A | 4/1992 | Hughes |
| 5,145,258 | A | 9/1992 | Schneck et al. |
| 5,152,612 | A | 10/1992 | Shoemaker |
| 5,160,308 | A | 11/1992 | Peppiatt |
| 5,282,687 | A | 2/1994 | Yee |
| 5,340,217 | A | 8/1994 | Rothman |
| 5,458,556 | A | 10/1995 | Hlubik |
| D373,515 | S | 9/1996 | Melk |
| 5,722,773 | A | 3/1998 | Conrad |
| 5,741,077 | A | 4/1998 | Sasaki et al. |
| 5,816,992 | A | 10/1998 | Conrad |
| D403,926 | S | 1/1999 | Sutton |
| 5,879,083 | A | 3/1999 | Nelson et al. |
| 5,993,062 | A | 11/1999 | Shackleton |
| 6,092,687 | A | 7/2000 | Hupp et al. |
| D452,075 | S | 12/2001 | Mogil |
| 6,325,239 | B2 | 12/2001 | Randall et al. |
| 6,374,461 | B1 | 4/2002 | Gober et al. |
| 6,443,617 | B2 | 9/2002 | Tetenborg |
| D479,898 | S | 9/2003 | Scola |
| 6,644,063 | B2 | 11/2003 | Mogil |
| 6,899,663 | B2 | 5/2005 | Tetenborg |
| 6,957,915 | B2 | 10/2005 | Tankersley |
| D531,458 | S | 11/2006 | Lown et al. |
| 7,207,716 | B2 | 4/2007 | Buchanan et al. |
| D549,445 | S | 8/2007 | Lown et al. |
| 7,341,377 | B1 | 3/2008 | Baxter |
| 8,177,431 | B2 | 5/2012 | Turvey et al. |
| 8,267,580 | B2 | 9/2012 | Schneider |
| 2006/0188177 | A1 | 8/2006 | Dyer et al. |
| 2007/0071370 | A1 | 3/2007 | Schneider |
| 2008/0013867 | A1 | 1/2008 | Liu |
| 2010/0135602 | A1 | 6/2010 | Turvey et al. |

FLEXIBLE CONTAINER

CROSS REFERENCE TO RELATED APPLICATIONS

This application is a continuation application of U.S. patent application Ser. No. 13/315,203, filed on Dec. 1, 2008, now U.S. Pat. No. 8,746,495.

REFERENCE REGARDING FEDERALLY SPONSORED RESEARCH OR DEVELOPMENT

Not applicable.

SEQUENTIAL LISTING

Not applicable.

FIELD OF THE INVENTION

The present invention relates generally to a container, and, more particularly, to a flexible container that has a flexible handle, and attachment of the flexible handle to the container.

BACKGROUND OF THE INVENTION

A flexible container may be used to carry a variety of items, for example, clothes, books, blankets, groceries, and baby supplies. A typical flexible container may have one or more flexible handles, which may make the container easier to carry. Such flexible handles are made from paper, thermoplastic, burlap, and other material.

One type of flexible container includes an open end and patches of reinforcing material, such as cardboard, adhesively attached to oppositely disposed gusseted sidewalls proximate to the open end. Hand apertures are disposed through each sidewall and the attached patch of reinforcing material. Each patch has a first line of slits disposed therethrough that extends along the entire length thereof and a second line of slits disposed therethrough that extends partially across a central portion of the patch. The first line of slits defines a first fold line in each patch for closing the container and the second line of slits defines a second fold line about which locking flaps can be folded such that the flaps fit through respective hand apertures. Folding the locking flaps through the hand apertures creates a reinforced handle for carrying the flexible container.

Another flexible container is manufactured from an extrudable heat sealable material and includes front and rear walls, a bottom wall, and gusseted side walls. A heat seal region joins the front and rear walls at a top portion thereof. A cut-out handle flap that is formed through the heat seal region is folded over to provide a handle. A further similar flexible container includes a front wall and a back wall made from a flaccid polymeric material such as a polyethylene film. Top portions of the front and back walls are joined by first and second lines of horizontal securement. A continuous curvilinear slit is disposed through the front and back walls between the first and second lines of horizontal securement. The slit is downwardly concave in a center portion thereof and upwardly concave on end portions thereof such that the slit forms two flaps that are folded to provide a handle.

Yet another flexible container includes a main tubular body portion and an extension thereto and is made of a flexible sheet material. A top edge of the main portion is folded inwardly over a strip of additional material to form a reinforced hem. The extension includes material in the form of a tube attached to an interior side of the reinforced hem. A strap handle also made from the same material as the main body portion and the extension is attached between the hem and the extension by a line of stitching that extends through the extension, the strap handle, and the reinforced hem.

A further flexible container is made of a heavy duty plainwoven fabric, such as a burlap weave. Lifting loops are made of the same plainwoven material as the flexible container and are longitudinally folded at least twice to form three layers that are stitched together to form lifting members. In one embodiment, lifting members are stitched inside a vertical hem that is formed by folding over an edge of a side panel of the flexible container. In another embodiment, lifting members are stitched between a horizontal hem that is formed by folding over a top edge of each side panel and a layer of webbing exterior to the hem.

A still further flexible container is made of a plastic sheet folded to form sidewalls. Each sidewall of the flexible container is folded inwardly along a fold line at a top edge of the flexible container to form a horizontal hem and a pair of slits is disposed through the fold line on each of two opposing sidewalls. Ends of strap handles are disposed through the pairs of slits and sandwiched between horizontal reinforcement straps disposed within each hem. Adhesive is applied between the strap handles, the reinforcing straps, and interior surfaces of the hem to secure the strap handles to the flexible container.

A common problem associated with flexible handles is a lack of lifting capacity, because the flexible handles have a tendency to fail under stress. For example, the flexible handles may rip apart, tear the flexible container at a point of attachment, or simply disengage from the flexible container. The use of burlap or other heavy material may inhibit failure, but also may add excessively to the cost of manufacture and may not be appropriate for use on mass-produced flexible containers made from paper or thermoplastic. There is a need for a flexible handle that is economical, has increased lifting capacity, and is applicable to mass-produced flexible containers.

SUMMARY OF THE DISCLOSURE

According to one aspect of the disclosure, a flexible container comprises a container wall and a handle attached to the wall. The handle includes multiple layers of thermoplastic material having stitching applied through the multiple layers, and a portion of the handle is attached to the container wall.

According to another aspect of the disclosure, a flexible container comprises a container wall and a handle attached to the wall. The handle includes a unitary sheet of thermoplastic material folded over and stitched to itself, and a portion of the sheet is attached to the container wall. The sheet includes first and second flaps each defined by a continuous slit disposed through the sheet and folded to provide first and second apertures, respectively, through the sheet.

According to yet another aspect of the disclosure, a flexible container comprises a container wall and a handle attached to the wall. The handle includes multiple layers of thermoplastic material folded over and a central aperture disposed therethrough. A first set of stitching is applied through the multiple layers and extends around the central aperture and around a portion of the perimeter handle. A portion of the handle is attached to the container wall by a second set of stitching.

BRIEF DESCRIPTION OF THE DRAWINGS

Other aspects and advantages of the present disclosure will become apparent upon consideration of the following detailed description, wherein similar structures have the same reference numerals throughout.

DETAILED DESCRIPTION

The present invention is directed to a flexible container that has a flexible handle attached thereto. While specific embodiments are discussed herein, it is understood that the present disclosure is to be considered only as an exemplification of the principles of the present invention. Therefore, the present disclosure is not intended to limit the invention to the embodiments illustrated.

Figure 1A:
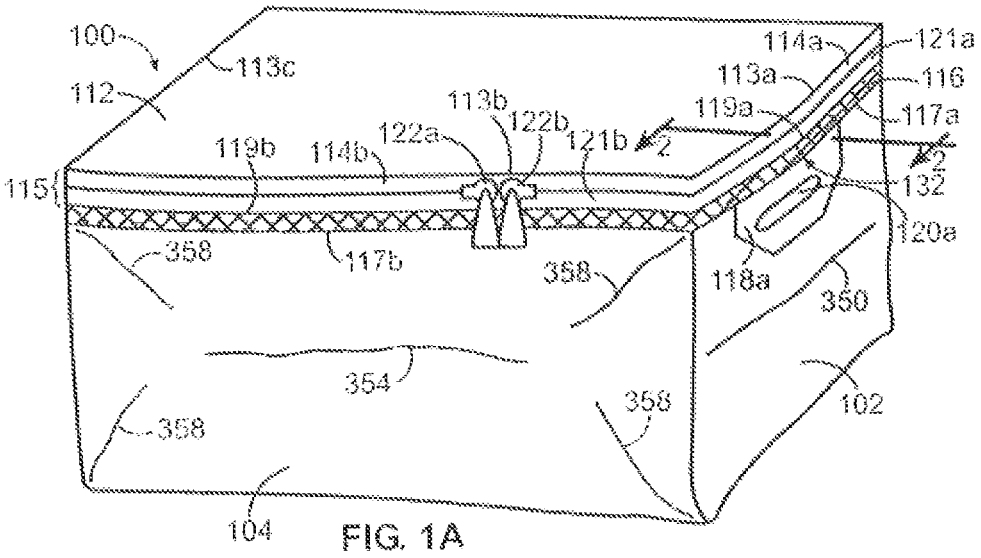
FIG. 1A is a top isometric view of a front side of a flexible container.
Figure 1B:
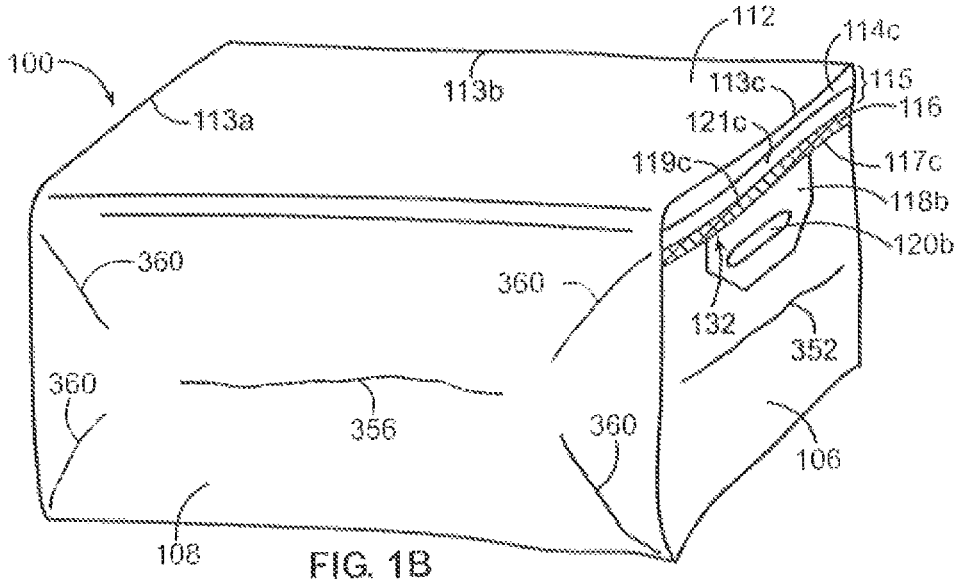
FIG. 1B is a top isometric view of a rear side of the flexible container of FIG. 1A.
Figure 1C:
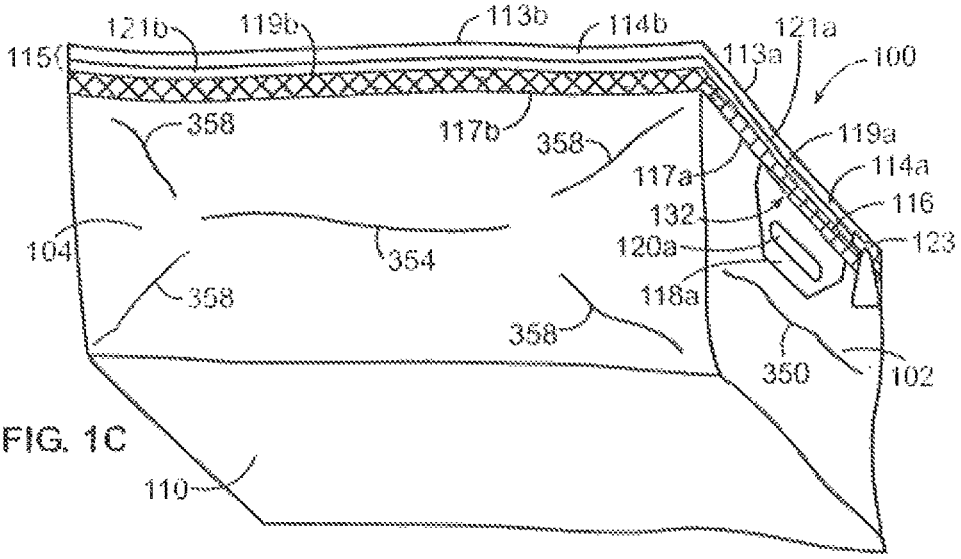
FIG. 1C is a bottom isometric view of the front side of the flexible container of FIG. 1A.
Figure 1D:
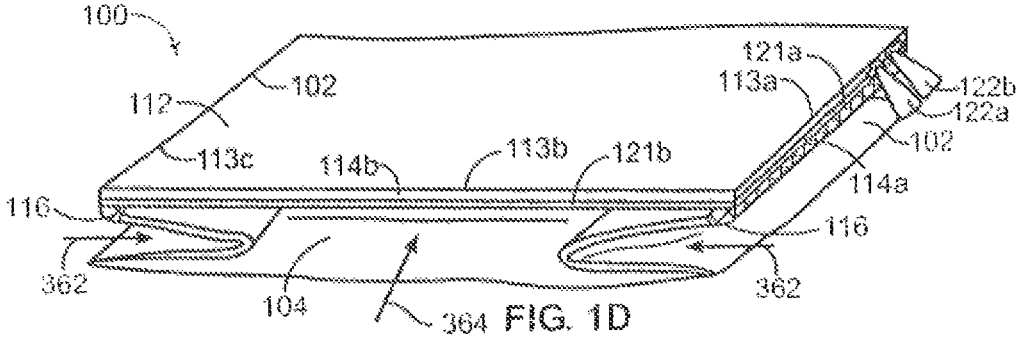
FIG. 1D is a top isometric view of the flexible container of FIG. 1A in a collapsed state.
Figure 1E:
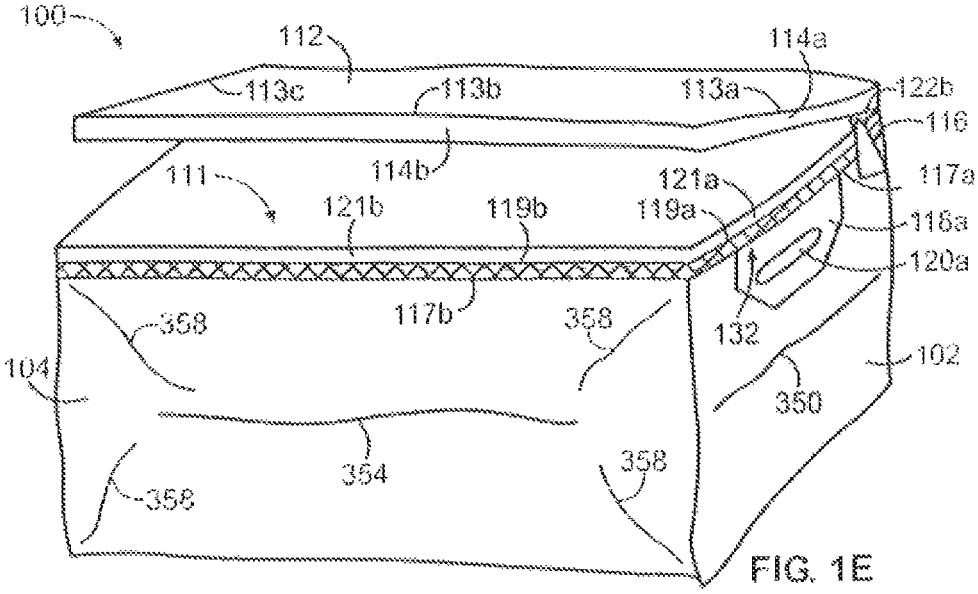
FIG. 1E is a top isometric view of the flexible container of FIG. 1A in an open state.

A flexible container 100 having six panels is illustrated in FIGS. 1A-1E. The panels include first, second, third, and fourth side walls 102, 104, 106, 108, a bottom panel 110 and a top panel or cover 112. The cover 112 is permanently attached to one of the walls, for example, the fourth wall 108 and encloses an interior 111 of the container 100, as shown in FIG. 1E. Three outer edges 113*a*-113*c* of the cover 112 include first elements 114*a*-114*c* of a reclosable fastener 115. A continuous mesh material layer 116 is attached to each of the first, second, and third walls 102, 14, 106 along a first or bottom end 117*a*-117*c*, respectively, of the mesh material layer 116, wherein such attachment will be described in greater detail hereafter. Second or top ends 119*a*-119*c* of the mesh material layer 116 include second elements 121*a*-121*c*, respectively, of the reclosable fastener 115. The first and second elements 114*a*-114*c*, 121*a*-121*c* of the reclosable fastener 15 join together to close the flexible container 100, and the mesh material layer 116 provides ventilation for the flexible container 100 when closed. Two closure elements 1221, 122*b* are disposed on the first and second elements 114*a*-114*c*, 121*a*-121*c* of the reclosable fastener 115 to open and to close reclosable fastener 115, wherein the two closure elements 122*a*, 122*b* allow the reclosable fastener 115 to be closed at any point. Optionally, only one closure element 123 may be utilized, as shown in FIG. 1C.

Each of the panels is made of a flexible material, for example, a thermoplastic film. Optionally, the panels may be made of any other flexible material, such as a woven material, fabric, or any other flexible material known in the art. Each of the panels may be formed of independent sheets of material that are joined to one another at edges thereof or may be formed integrally of a single sheet of material folded to form two or more of the other panels. In one embodiment, the cover 112 is integral with the bottom panel 110 via the fourth wall 108, and the first wall 102 is integral with the third wall 106 via the second wall 104. Any of the panels may be joined together by heat sealing, stitching, adhesive, or by any other means known to one having skill in the art. The mesh material layer 116 may be made from criss-crossed woven strands, for example, strands of vinyl, string, wire, or other flexible stranded material known to one have skill in the art. The reclosable fastener 115 also may be a zipper, a hook and loop type fastener, a continuous tongue and groove type fastener, or other type of fastener as known to one having skill in the art.

In the flexible container 100 illustrated in FIGS. 1A-1C, flexible handles 118*a*, 118*b* are attached to the first and third walls 102, 106, respectively. Each of the flexible handles 118, 118*b* includes an aperture 120*a*, 120*b* disposed therethrough and is made of a flexible material, for example, a textile, rubber, wire mesh, a thermoplastic film, or other material that is known to one having skill in the art. Although two flexible handles 118*a*, 118*b* are depicted, any number of flexible handles 118*a*, 118*b* may be utilized. Also, the flexible handles 118*a*, 118*b* may be attached to any of the walls 102, 104, 106, 108, as described in greater detail hereafter.

In other embodiments (not shown), the flexible container may be formed of any number of side walls with or without a bottom panel and/or cover, a cylindrical wall with a circular bottom panel and cover, and/or side walls forming any polygonal shape. A flexible handle may be attached to one or more walls, for example, by stitching, adhesive, thermoplastic welding, or other method of attachment as known to one having skill in the art. Further, a cover may be permanently attached to any wall or removably attached to one or more walls, for example, via a reclosable fastener.

Figure 2:
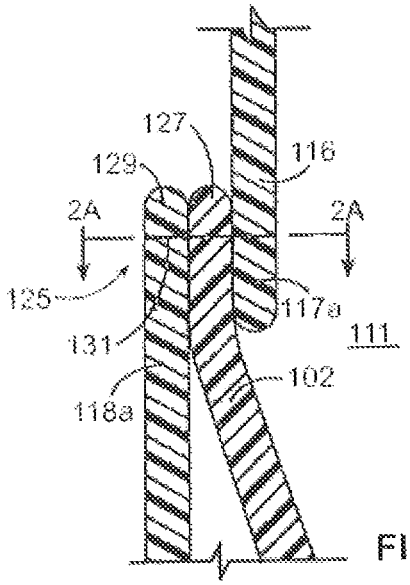
FIG. 2 is a fragmentary cross-sectional view taken generally along the lines 2-2 of FIG. 1A depicting a first attachment for connecting a flexible handle to the container of FIGS. 1A-1E.
Figure 2A:
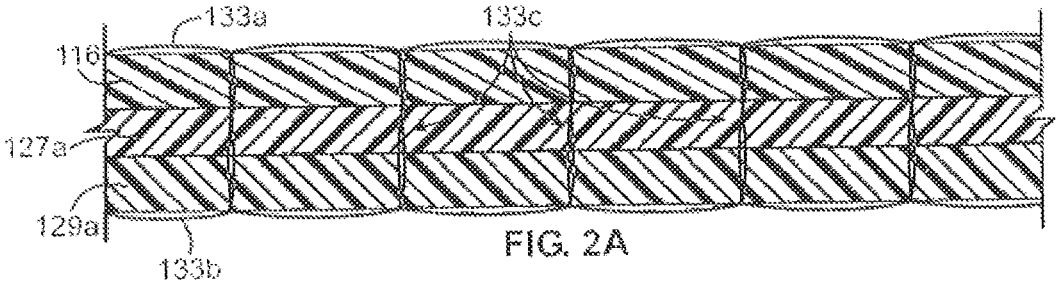
FIG. 2A is a fragmentary cross-sectional view taken generally along the lines 2A-2A of FIG. 2 depicting a method for stitching layers of material together.

FIG. 2 illustrates an attachment for connecting the flexible handle 118*a* to the walls 102, for example, which is made of a thermoplastic layer of film. At a point of attachment 125 of the handle 118*a* to the wall 102, the bottom end 117*a* of the mesh material layer 116 is disposed internal to and adjacent to a top end 127 of the wall 102, and a first end 129 of the flexible handle 118*a* is disposed external to and adjacent to the top end 127 of the wall 102. The bottom end 117*a* of the mesh material layer 116, the top end 127 of the wall 102, and the first end 129 of the flexible handle 118*a* are joined by stitching 131 disposed therethrough. The stitching 131 preferably extends across an entire connecting edge 132 of the handle 118*a*, as shown in FIGS. 1A-1C and 1E, and may include string, wire, stranded vinyl, other flexible standard material, as known to one having skill in the art, or combinations thereof. The stitching 131 is preferably a single line of lock stitching that uses two pieces of flexible stranded material 133*a*, 133*b* that loop over one another at points 133*c*, as illustrated in FIG. 2A. Alternatively, the stitching 131 may be any type of stitching as known in the art.

Figure 3A:
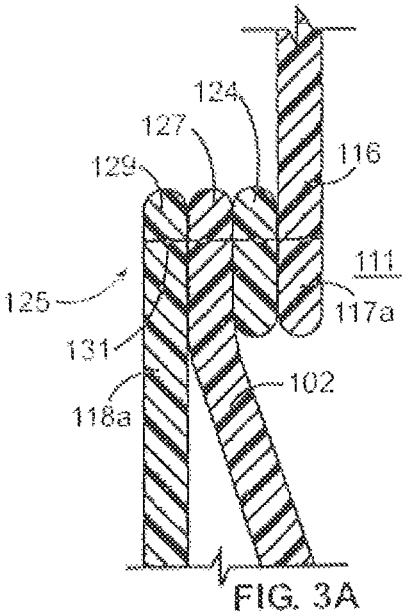
FIG. 3A is a fragmentary cross-sectional view taken generally along the lines 2-2 of FIG. 1A of a second attachment for connecting a flexible handle to the container of FIGS. 1A-1E.

FIG. 3A illustrates a further attachment for connecting the flexible handle 118*a* to the wall 102. At the point of attachment 125, the bottom end 117*a* of the mesh material layer 116 is disposed internal to and adjacent to a first binding material layer 124. The binding material may be, for example, fabric, canvas, polyester, polyethylene, or other material. The top end 127 of the wall 102 is disposed external to and adjacent to the binding material layer 124, and the first end 129 of the flexible handle 118*a* is disposed external to and adjacent to the top end 127 of the wall 120. The bottom end 117*a* of the mesh material layer 116, the binding material layer 124, the top end 127 of the wall 102, and the first end 129 of the flexible handle 118*a* are joined by the stitching 131 disposed therethrough.

Figure 3B:
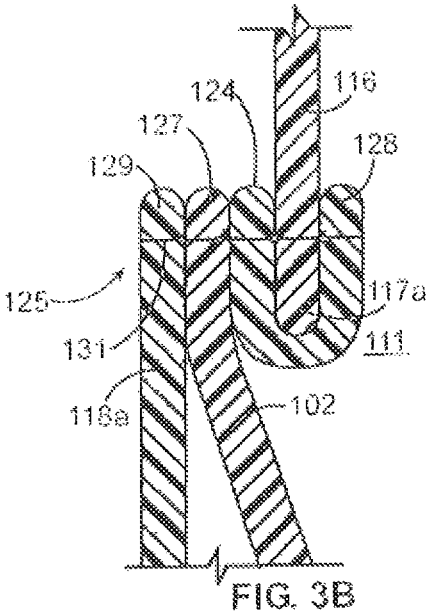
FIG. 3B is a fragmentary cross-sectional view taken generally along the lines 2-2 of FIG. 1A showing a third attachment for connecting a flexible handle to the container of FIGS. 1A-1E.

A further attachment is illustrated in FIG. 3B that is similar to the attachment described above with respect to FIG. 3A, except for the following differences. A second binding material layer 128 is disposed internal to and adjacent to the bottom end 117*a* of the mesh material layer 116. The first and second binding material layers 124, 128 may be two independent pieces of material or may be a unitary piece of material folded over the bottom end 117*a* of the mesh material layer 116, as illustrated in FIG. 3B. The second binding material layer 128, the bottom end 117*a* of the mesh material layer 116, the first binding material layer 124, the top end 127 of the wall 102, and the first end 129 of the flexible handle 118*a* are joined by the stitching 131 disposed therethrough.

Figure 4A:
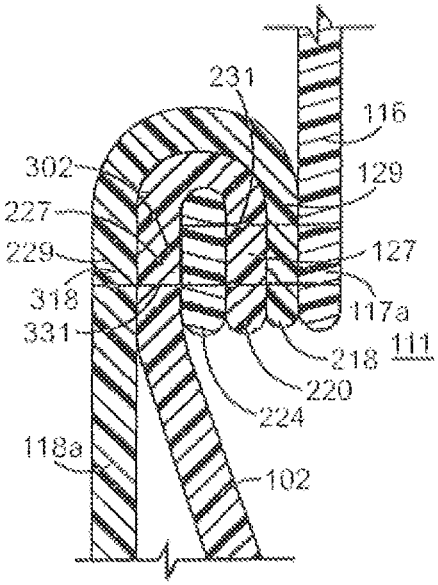
FIG. 4A is a fragmentary cross-sectional view taken generally along the lines 2-2 of FIG. 1A illustrating a fourth attachment for connecting a flexible handle to the container of FIGS. 1A-1E.

In a further attachment for connecting the flexible handle 118*a* to the wall 102, illustrated in FIG. 4A, the bottom end 117*a* of the mesh material layer 116 is disposed internal to and adjacent to a first flexible handle layer 218, which is formed by the first end 129 of the flexible handle 118*a*. A first thermoplastic layer 220 formed by the top end 127 of the wall 102 is disposed external to and adjacent to the first flexible handle layer 218, and a first binding material layer 224 is disposed external to the first thermoplastic layer 220. The bottom end 117*a* of the mesh material layer 116, the first flexible handle layer 218, the first thermoplastic layer 220, and the first binding material layer 224 are joined by a first set of stitching 231 disposed therethrough. A second thermoplastic material layer 302 is disposed external to and adjacent to the first binding material layer 224 and is integral with the first thermoplastic material layer 220, as illustrated in FIG. 4A, wherein the second thermoplastic material layer 302 is formed by an intermediate portion 227 of the wall 102. A second flexible handle layer 318 is disposed external to and adjacent to the second thermoplastic layer 302, wherein the second flexible handle layer 318 is integral with the first flexible handle layer 218 and is further formed by an intermediate portion 229 of the flexible handle 118*a*. The bottom end 117*a* of the mesh material layer 116, the first flexible handle layer 218, the first thermoplastic layer 220, the first binding material layer 224, the second thermoplastic layer 302, and the second flexible handle layer 318 are joined by a second set of stitching 331 disposed therethrough.

Figure 4B:
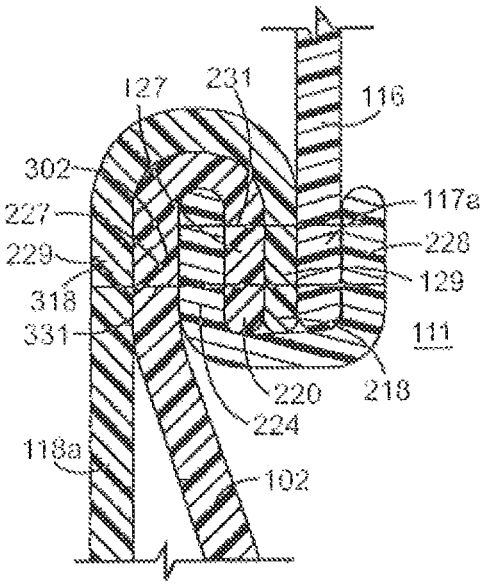
FIG. 4B is a fragmentary cross-sectional view taken generally along the lines 2-2 of FIG. 1 depicting a fifth attachment for connecting a flexible handle to the container of FIGS. 1A-1E.

FIG. 4B illustrates another attachment for connecting the flexible handle 118*a* to the wall 102, which is similar to the embodiment described above with respect to FIG. 4A, except for the following differences. A second binding material layer 228 is disposed internal to the mesh material layer 116. The first and second binding material layers 224, 228 may be two independent pieces of material or may be a unitary piece of material folded over the bottom end 117*a* of the mesh material layer 116, the first flexible handle layer 218, and the first thermoplastic layer 220, as illustrated in FIG. 4B. The second binding material layer 228, the mesh material layer 116, the first flexible handle layer 218, the first thermpoplastic layer 220, and the first binding material layer 224 are joined by the first set of stitching 231 disposed therethrough. Further, the second binding material layer 228, the mesh material layer 116, the first flexible handle layer 218, the first thermoplastic layer 220, the first binding material layer 224, the second thermoplastic layer 302, and the second flexible handle layer 318 are joined by the second set of stitching 331 disposed therethrough.

Any of the attachments described in FIGS. 2, 3A, 3B, 4A, and 4B may be utilized to connect a flexible handle 118*a*, 118*b* to any of the side walls 102, 104, 106, 108 of the flexible container 100. Further, if more than one flexible handle 118*a*, 118*b* is utilized for a flexible container 100, the same attachment need not necessarily be utilized for all of such flexible handles 118*a*, 118*b*.

The flexible container 100 may be collapsed, as depicted in FIG. 1D. In particular, the container 100 is folded by collapsing the opposing walls 102, 106 inwardly along horizontal creases 350, 352, respectively, as indicated by the arrows 362. As the walls 102, 106 are collapsed inwardly, the opposing walls 104, 108 are also collapsed inwardly along horizontal creases 354, 356 and diagonal creases 358, 360, respectively, as indicated by the arrow 364. This collapsed state minimizes the space need for the container 100 when not in use by minimizing a distance between the bottom and top panels 110, 112.

Figure 5A:
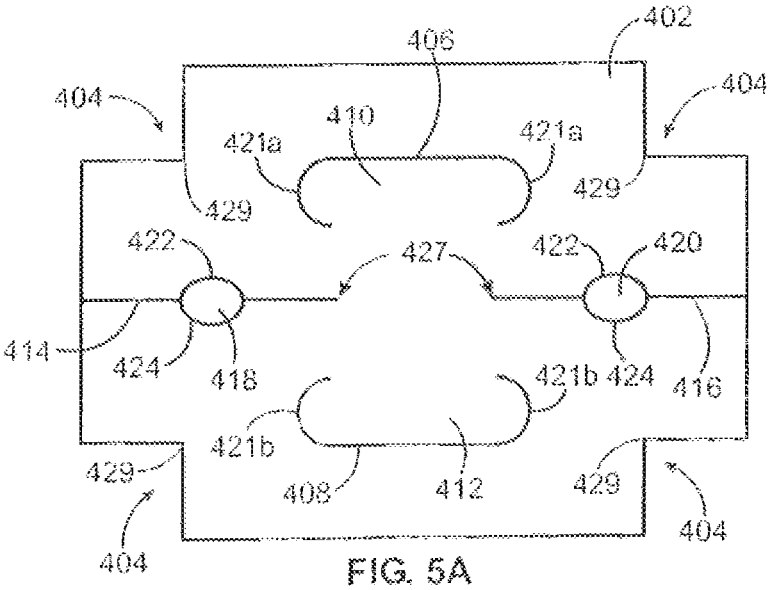
FIGS. 5A-5D illustrate a first method of folding a sheet of thermoplastic material to form a flexible handle.
Figure 5B:
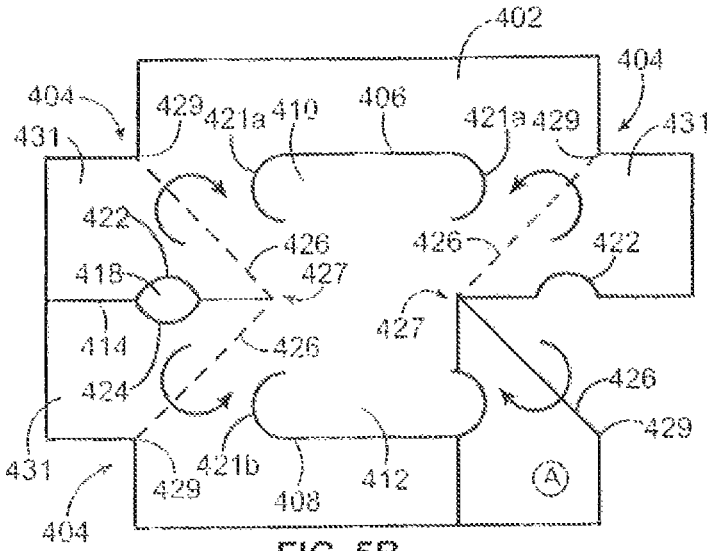
Figure 5C:
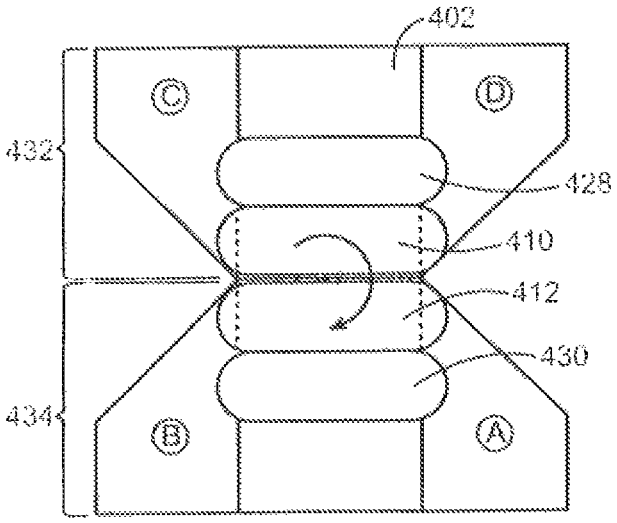
Figure 5D:
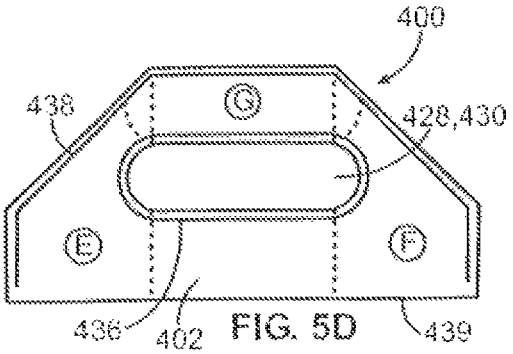

A flexible handle, for example, the flexible handle 118*a*, includes the first and second flexible handle layers 218 and 318 described above, and may be made from a unitary sheet of thermoplastic material or multiple sheets of thermoplastic material. For example, a flexible handle 400, as illustrated in FIG. 5D, is made from a unitary sheet of thermoplastic material 402, as illustrated in FIGS. 5A-5C. Referring to FIG. 5A, the sheet 402 is generally rectangular with notched corners 404 and includes first and second slits 406, 408 that define first and second handle flaps 410, 412, respectively. Third and fourth slits 414, 416 are disposed through the sheet 402 generally parallel with and spaced generally equidistant from the first and second slits 406, 408. First and second apertures 418, 420 are disposed through the sheet 402 and are bisected by the third and fourth slits 414, 416, respectively. Each of the first and second apertures 418, 420 includes a top edge contour 422 that has a shape that matches curved end portion 421*a* of the first slit 406 and a symmetrical bottom edge contour 424 that has a shape that matches curved end portions 421*b* of the second slit 408.

Fold lines 426 connect ends 427 of each of the third and fourth slits 414, 416 to corners 427 of the notches 404, as shown by the dashed lines in FIG. 5B. Side flaps 431 defined by the fold lines 426 are folded inwards, as indicated in FIG. 5B, such that the top and bottom edge contours 422, 424 are coincident with the end portions 421*a*, 421*b* of the first and second slits 406, 408, respectively. For example, the lower right side flap 431 is folded forwards along the fold line 426 to form region A, which, after the folding operation, comprises two layer of thermoplastic material.

As illustrated in FIG. 5C, each of the side flaps 431 defined by the fold lines 426 is folded forwards along respective fold lines 426 to form the region A and regions B, C, and D, wherein all of such regions comprise two layers of thermoplastic material. The first and second handle flaps 410, 412 are thereafter folded forwards and toward one another to form first and second apertures 428, 430, respectively. A top portion 432 of the sheet 402 is folded forwards over a bottom portion 434 of the sheet 402 such that the handle flaps 410, 412 are adjacent to one another to yield a final shape for the flexible handle 400, such that the first and second apertures 428, 430 are coincident, as illustrated in FIG. 5D. The resultant handle 400 includes regions E, F, and G, wherein each region E, F, and G includes four layers of thermoplastic material. The four layers of material at the regions E, F, and G provide structural integrity to the handle 400 to prevent ripping, stretching, and/or breakage of the handle 400. A first set of stitching 436 extends continuously around the first and second apertures 428, 430 and a second set of stitching 438 extends around a portion of the perimeter of the handle 400, preferably excluding an edge 439 of the handle 400. The stitching 436, 438 may be formed using string, wire, stranded vinyl, or other flexible stranded material that is known to one having skill in the art.

Figure 6A:
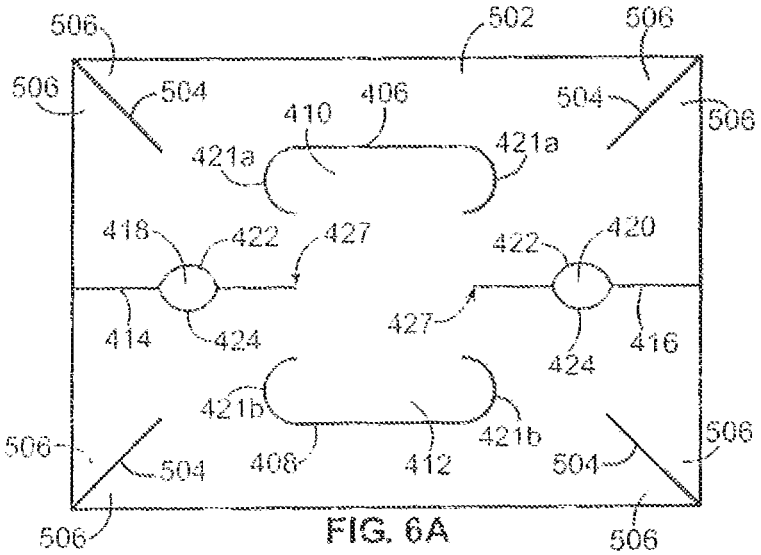
FIGS. 6A-6E illustrate a second method of folding a sheet of thermoplastic material to form a flexible handle.
Figure 6B:
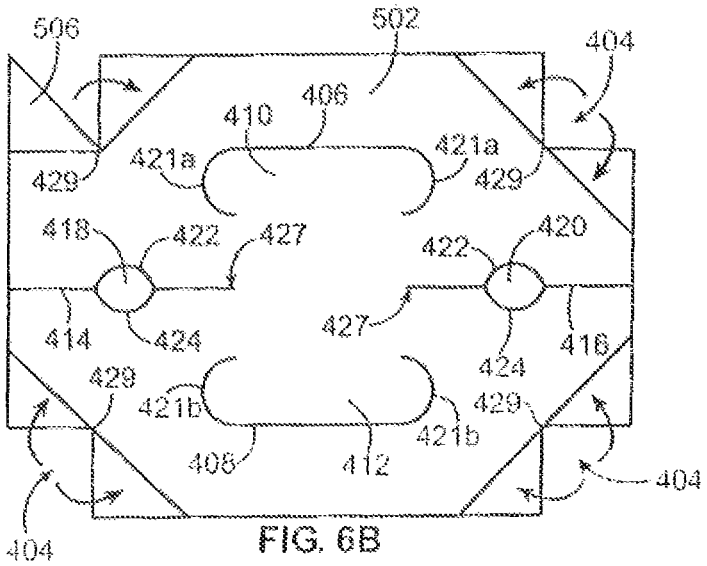
Figure 6C:
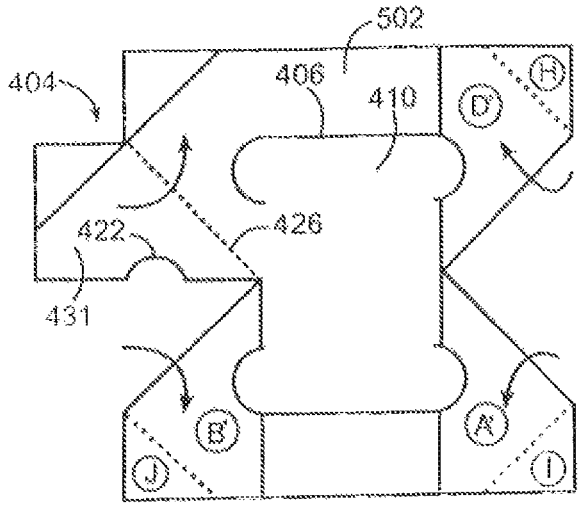
Figure 6D:
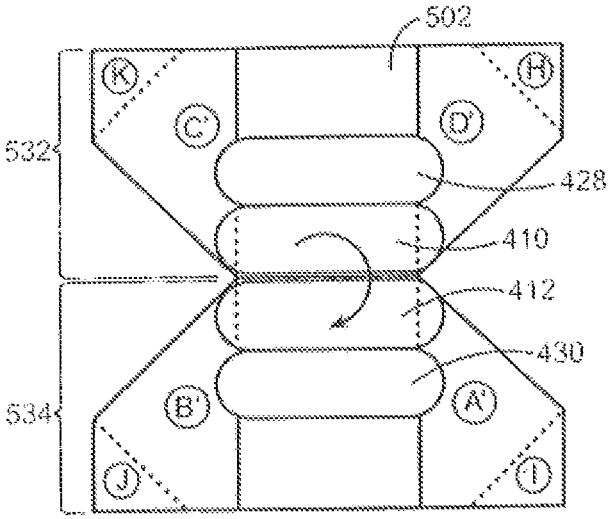
Figure 6E:
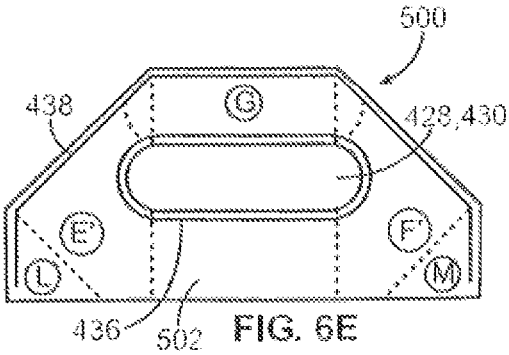

A further flexible handle 500, as illustrated in FIG. 6E, is made from a unitary sheet of thermoplastic material 502, as illustrated in FIGS. 6A-6D. The handle 500 and the sheet of thermoplastic material 502 are similar to the handle 400 and the sheet of thermoplastic material 402 described above with respect to FIGS. 5A-5D, wherein identical reference numerals refer to identical features, except for the following differences. Referring to FIG. 6A, the sheet 502 lacks the notches 404 of FIGS. 5A and 5B at corners thereof. Instead, corner slits 504 are disposed through the sheet 502 and extend diagonally inwardly from each corner to form triangular shaped flaps 506. As illustrated in FIG. 6B, each of the triangular shaped flaps 506 is folded forwards, as indicated, to form the notches 404. Following the steps described with respect to FIG. 5B, each of regions A', B', C', and D' in FIGS. 6C and 6D are formed, wherein each region A', B', C', and D' comprises two layers of thermoplastic material. In addition, each of the regions H, I, J, and K illustrated in FIGS. 6C and 6D comprises four layers of thermoplastic material.

As illustrated in FIGS. 6D and 6E, a top portion 532 of the sheet 502 is folded forwards over a bottom portion 534 of the sheet 502 to yield a final shape for the flexible handle 500 of FIG. 6E such that the first and second apertures 428, 430 are coincident. Each region E', F', and G of the handle 500 comprises four layers of thermoplastic material. In this embodiment, however, regions L and M comprise eight layers of thermoplastic material.

Figure 7A:
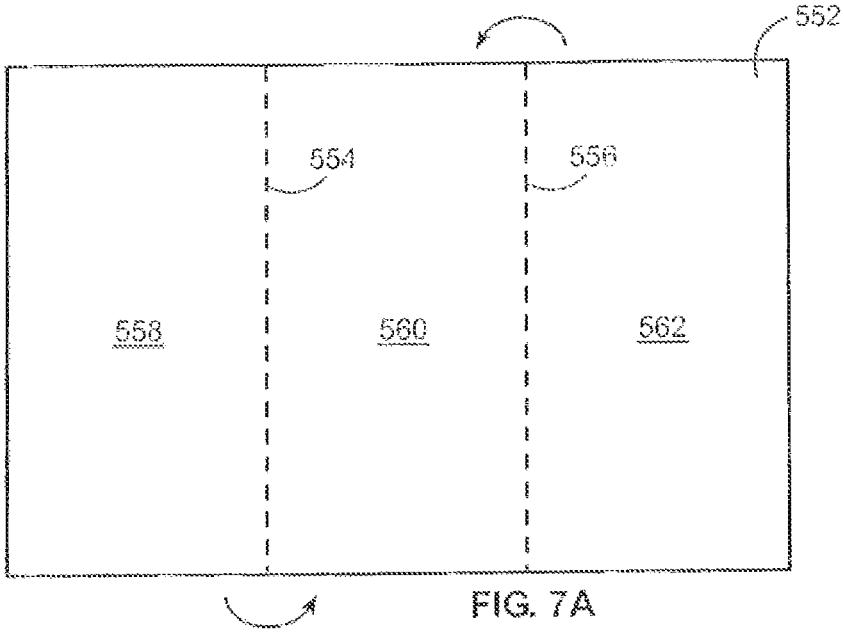
FIGS. 7A-7C illustrate a method of layering multiple sheets of thermoplastic material to form a flexible handle.
Figure 7B:
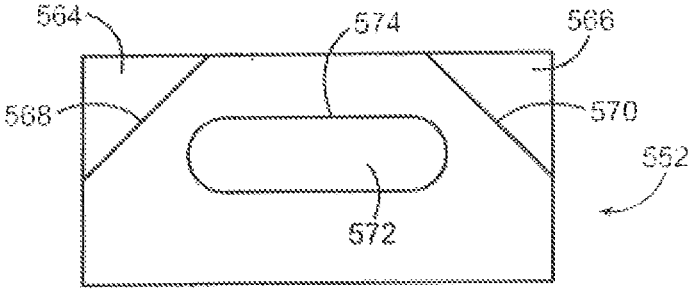
Figure 7C:
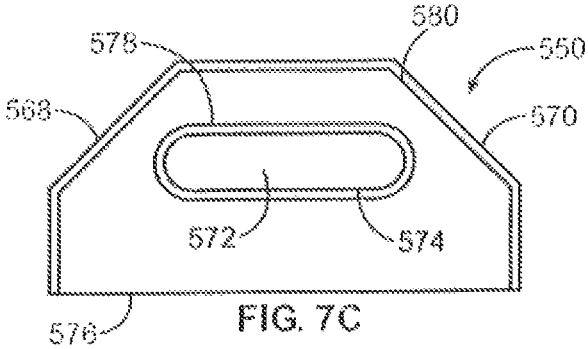

It is also contemplated that another embodiment of a flexible handle 550 may be made from a unitary sheet of thermoplastic material, as illustrated in FIGS. 7A-7C. Referring to FIG. 7A, a blank of thermoplastic material 552 is divided by fold lines 554 and 556 into any number of regions, for example, three regions, 558, 560, and 562. The blank 552 is folded over onto itself, for example, by folding the region 558 under the region 560 and folding the region 562 over the region 560 to form three layers. Other patterns of folding the regions over one another may also be utilized.

Referring to FIG. 7B, corners 564 and 566 of the folded blank 552 are sliced off along cut lines 568 and 570, respectively, and a central aperture 572 that is defined by an edge 574 is stamped out of the folded blank 552. Referring to FIG. 7C, the edge 574 and a perimeter 576 of the folded blank 552 are heat sealed. A first set of stitching 578 is applied through the folded blank 552 around the edge 574. A second set of stitching 580 is applied through the folded blank 552 along at least a portion of the perimeter 576 to complete the flexible handle 550.

It is also contemplated that a further embodiment of a flexible handle (not shown) may be made from multiple sheets of thermoplastic material. Referring to FIG. 7A, instead of being folded along the fold lines 554 and 556, the blank 552 of the present embodiment could alternatively be sliced along the fold lines 554 and 556 to yield multiple sheets of thermoplastic material that may be layered over one another and subsequently sliced and stamped (as discussed above with respect to FIG. 7B). Following the heat sealing and stitching steps (as discussed above with respect to FIG. 7C), such a completed flexible handle made from multiple sheets of thermoplastic would appear very similar to the prior described flexible handle 550 made from a unitary piece of thermoplastic material. Although three sheets or layers of thermoplastic material are depicted in FIGS. 7A-7C as regions 558, 560, and 562, any number of sheets or layers may be utilized.

The flexible handles 400, 500, and 550 of FIGS. 5D, 6E, and 7C, respectively, are illustrative and are not intended to limit the disclosure to the patterns of slits and folds described herein. Other flexible handles may include, for example, multiple sheets of thermoplastic material layers disposed upon one another as described above, multiple sheets of thermoplastic material layers disposed upon one another and subsequently folded, multiple apertures disposed therethrough, adhesives used in addition to stitching, and/or other patterns and combinations.

Figure 8:
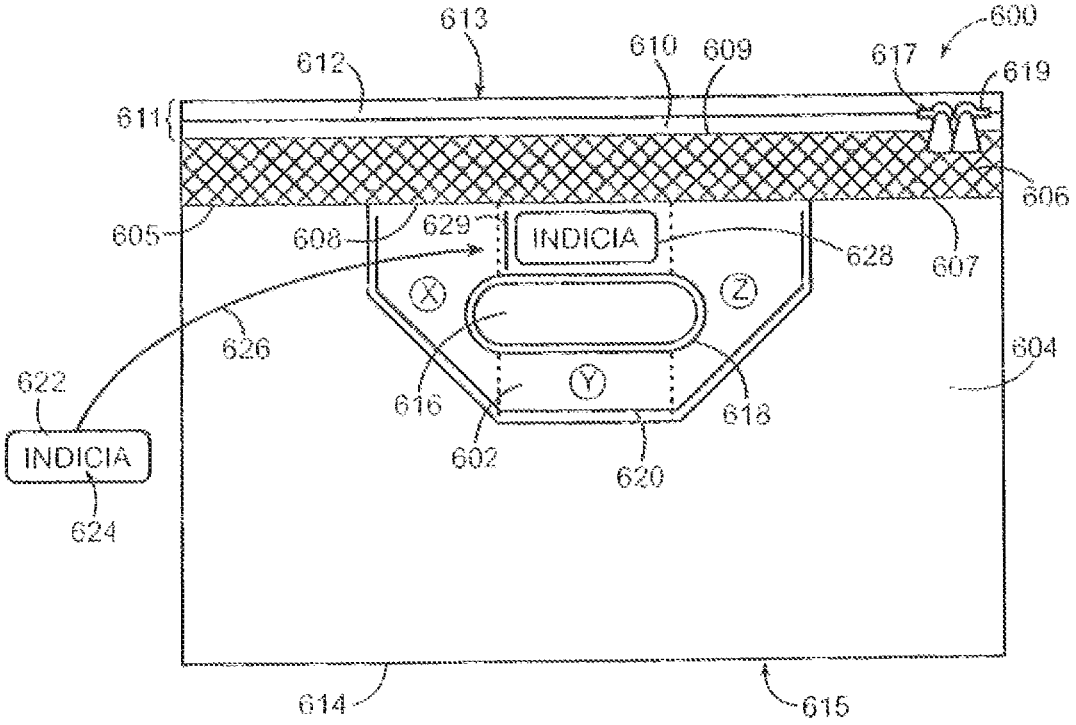
FIG. 8 is a plan view of a flexible handle that includes a visible indicium and is attached to the flexible container of FIGS. 1A-1E.

FIG. 8 illustrates a flexible container 600 having a flexible handle 602 attached to a wall 604 of the flexible container 600. A first edge 605 of a mesh material layer 606 is attached to a first edge 607 of the wall 604 by a line of stitching 608 that also attaches the flexible handle 602 to the wall 604. A second edge 609 of the mesh material layer 606 is attached to a first element 610 of a reclosable fastener 611, a second element 612 of which is attached to a cover 613 (seen on edge in FIG. 8). Two closure elements 617, 619 are disposed on the first and second elements 610, 612 of the reclosable fastener 611 to open and to close the fastener 611, wherein the two closure elements 610, 612 allow the reclosable fastener 611 to be closed at any point. Optionally, only one closure element, for example, the closure element 617 may be utilized.

A second edge 614 of the wall 604 is attached to a bottom panel 615 (seen on edge in FIG. 8). The flexible handle 602 includes an aperture 616 disposed therethrough and is attached to the wall 604, such that the aperture 616 lies between the bottom panel 615 and the line of stitching 608. The flexible handle 602 further includes stitching 618 that extends continuously around the aperture 616 and stitching 620 that extends around a portion of the perimeter of the handle 602.

It is contemplated that because a thermoplastic material may be used in the manufacture of the flexible handles 400, 500, 602, and the thermoplastic material is transparent or at least transmissive, the flexible handles 400, 500, 602 may be used to display an indicium, for example, a label, a logo, or a combination of words and/or images. For example, as illustrated in FIG. 8, a piece of material 622 has an indicium 624 printed or otherwise embossed on a surface thereof. The material 622 may be, for example, paper, cardboard, plastic, cloth, or any material that can be printed upon or embossed with the indicium 624 as known to one having skill in the art. As indicated by the arrow 626, the piece of material 622 is disposed within layers of the flexible handle 602 as shown at position 628. The indicium 624 is thus held within the handle 602 and is visible from outside of the handle 602. The indicium 624 may be held within the handle 602 at any desired region between the layers of the flexible handle 602, for example, as shown at position 628 or at any of positions X, Y, and Z and/or overlapping one or more of these regions. The indicium 624 may be inserted within the handle 602 during manufacture thereof or at a slit or other opening 629 may be formed within the handle 602 such that a user may insert the indicium 624 therein. Further, any number of indicium 624 may be utilized within any location in the handle 602 and in any number of handles within a container.

Although the flexible containers and components thereof may be described herein with respect to particular orientations (e.g., top, bottom, etc.), such orientations are for descriptive purposes only. It should be understood that such flexible containers and components thereof need not be positioned in a particular orientation.

Further, although various specific embodiments have been shown and described herein, this specification explicitly includes all possible permutations of combinations of the features, structures, and components of all of the embodiments shown and described.

INDUSTRIAL APPLICABILITY

A flexible container is presented that includes a handle made from multiple layers of thermoplastic material stitched through the multiple layers to provide increased strength for the handle. An indicium that is visible from outside of the handle may be held within the handle. The flexible container includes a layer of mesh material that provides ventilation for the flexible container and forms a reinforced attachment for connecting the handle to the flexible container to provide increased lifting capacity to the handle.

Numerous modifications to the present disclosure will be apparent to those skilled in the art in view of the foregoing description. Accordingly, this description is to be construed as illustrative only and is presented for the purpose of enabling those skilled in the art to make and to use the disclosure, and to teach the best mode of carrying out the same. The exclusive rights to all modifications that come within the scope of the appended claims are reserved. All patents, patent publications and applications, and other references cited herein are incorporated by reference herein in their entirety.

We claim:

1. A flexible container comprising:

a bottom wall;

a plurality of side walls, each extending upwardly from the bottom wall and each having a top end defining an opening into an interior of the container;

a top wall connected to the top end of at least one of the side walls, the top wall covering the opening;

a continuous mesh layer connected to the top end of at least one of the side walls, the continuous mesh layer providing ventilation to the interior of the container; and a flexible handle attached to an exterior surface of at least one of the side walls, the handle including multiple layers of flexible thermoplastic material connected together, with a first end of the handle being attached to (i) the at least one side wall near the top end thereof, and (ii) the continuous mesh layer.

2. The flexible container of claim 1, wherein the multiple layers of flexible thermoplastic material of the handle are connected together by stitching applied through the multiple layers.

3. The flexible container of claim 2, wherein the handle includes a central aperture disposed therethrough, and wherein a first portion of the stitching extends along an edge of the central aperture and a second portion of the stitching extends along the perimeter of the handle.

4. The flexible container of claim 1, wherein the handle is attached by stitching to (i) the at least one side wall and (ii) the continuous mesh layer.

5. The flexible container of claim 4, wherein the handle is attached to the exterior surface of the at least one side wall by the stitching.

6. The flexible container of claim 5, wherein the first end of the handle is attached to an interior surface of the at least one side wall, the handle is folded over a portion of the at least one side wall, and a portion of the handle is stitched to the exterior surface and to itself through the at least one side wall.

7. The flexible container of claim 1, wherein the handle further includes an indicium disposed on a piece of material that is connected between the layers of thermoplastic material and is visible from outside of the handle.

8. The flexible container of claim 1, wherein the handle is formed of a unitary sheet of thermoplastic film folded over and stitched to itself.

9. The flexible container of claim 1, further comprising a reclosable fastener that includes a first element and a second element, wherein the first element is attached to the top wall and the second element is attached to the continuous mesh layer.

10. The flexible container of claim 1, further comprising a first binding material layer, disposed between the continuous mesh layer and the at least one side wall, to which the continuous mesh layer is attached.

11. The flexible container of claim 10, wherein the first end of the handle is attached to (i) the top end of the at least one side wall, (ii) the first binding material layer, and (iii) the continuous mesh layer.

12. The flexible container of claim 11, further comprising a second binding material layer disposed adjacent to an internal surface of the continuous mesh layer.

13. The flexible container of claim 12, wherein the first end of the handle is attached to (i) the top end of the at least one side wall, (ii) the first binding material layer, (iii) the continuous mesh layer, and (iv) the second binding material layer.

14. A flexible container comprising:

a bottom wall;

a back wall extending from the bottom wall;

a front wall extending from the bottom wall and spaced opposite to the back wall;

a left side wall extending from the bottom wall and extending from the front wall to the back wall;

a right side wall extending from the bottom wall and extending from the front wall to the back wall;

a top wall attached to the back wall, the top wall hingedly covering an opening defined by the front wall, the back wall, the left side wall, and the right side wall, into an interior of the container;

a continuous mesh layer attached to the front wall, the left side wall, and the right side wall, the continuous mesh layer providing ventilation to the interior of the container; and a handle attached to at least one of the left and right side walls, the handle being formed of a unitary sheet of thermoplastic film folded over and forming at least two layers stitched together, with a first end of the handle being attached to (i) an exterior side of the at least one of the left and right side walls near the top thereof, and (ii) the continuous mesh layer.

15. The flexible container of claim 14, wherein the unitary sheet includes first and second flaps, each defined by a continuous slit disposed through the unitary sheet and folded to provide first and second apertures, respectively, through the unitary sheet.

16. The flexible container of claim 15, wherein each flap is folded such that the flaps lie within the handle.

17. The flexible container of claim 16, wherein the first and second flaps overlap on a first side of the apertures.

18. The flexible container of claim 17, further comprising stitching that continuously extends around the first and second apertures.

19. The flexible container of claim 14, further comprising stitching that extends around a portion of the perimeter of the handle.

20. The flexible container of claim 14, wherein the handle includes a region wherein the unitary sheet is folded over onto itself at least twice to provide at least four overlapping layers.

21. The flexible container of claim 20, wherein the handle is attached to the side wall by stitching through a portion of the region.

22. The flexible container of claim 14, wherein no portion of the handle projects above the top of the left or right side wall.

23. The flexible container of claim 14, further comprising a first horizontal crease in the left side wall, a second horizontal crease in the right side wall, a third horizontal crease in the front wall, and a fourth horizontal crease in the back wall, wherein the left side wall, the right side wall, the front wall, and the back wall collapse inwardly at the respective creases.

24. The flexible container of claim 23, further comprising diagonal creases in the front wall and the back wall, about which the front wall and the back wall collapse.

25. The flexible container of claim 14, further comprising a reclosable fastener that includes a first element and a second element, wherein the first element is attached to the top wall and the second element is attached to the continuous mesh layer.

26. The flexible container of claim 14, further comprising a first binding material layer disposed between at least one of the left and right side walls, and the continuous mesh layer.

27. The flexible container of claim 26, wherein the first end of the handle is attached to (i) the exterior side of the left or right side wall near the top, (ii) the first binding material layer, and (iii) the continuous mesh layer.

28. The flexible container of claim 27, further comprising a second binding material layer disposed adjacent to an internal surface of the continuous mesh layer.

29. The flexible container of claim 28, wherein the first end of the handle is attached to (i) the exterior side of the left or right side wall near the top, (ii) the first binding material layer, (iii) the continuous mesh layer, and (iv) the second binding material layer.

30. A flexible container comprising:

a bottom wall;

a plurality of side walls, each extending from the bottom wall toward a top edge and defining an interior of the container, each side wall comprising a horizontal crease spaced from the bottom wall and the top edge, with the side walls collapsible inwardly about the respective creases;

a top wall hingedly attached to the top edge of at least one of the side walls, the top wall hinging to cover an opening defined by the top edge into the interior;

a continuous mesh layer attached to at least one of the side walls, the continuous mesh layer providing ventilation to the interior of the container; and a handle attached to at least one of the side walls and the continuous mesh layer, the handle including multiple layers of thermoplastic material and a central aperture disposed therethrough.

31. The flexible container of claim 30, wherein a first set of stitching is applied through the multiple layers and extends around the central aperture and around a portion of the perimeter of the handle, and a portion of the handle is attached to the at least one of the side walls by a second set of stitching.

32. The flexible container of claim 30, wherein the plurality of side walls comprises first, second, third, and fourth thermoplastic side walls, and the bottom wall comprises a thermoplastic bottom wall.

33. The flexible container of claim 30, wherein the top wall includes a reclosable fastener disposed along an edge thereof to join the top wall with top edge portions of the remaining ones of the first, second, third, and fourth thermoplastic side walls, to close the container.

34. The flexible container of claim 30, further comprising a reclosable fastener that includes a first element and a second element, wherein the first element is attached to the top wall and the second element is attached to the continuous mesh layer.

35. The flexible container of claim 30, further comprising a first binding material layer disposed between the continuous mesh layer and the at least one side wall to which the continuous mesh layer is attached.

36. The flexible container of claim 35, wherein the handle is attached to (i) the at least one side wall, (ii) the first binding material layer, and (iii) the continuous mesh layer.

37. The flexible container of claim 36, further comprising a second binding material layer disposed adjacent to an internal surface of the continuous mesh layer.

38. The flexible container of claim 37, wherein the handle is attached to (i) the at least one side wall, (ii) the first binding material layer, (iii) the continuous mesh layer, and (iv) the second binding material layer.

* * * * *